US008567566B2

(12) United States Patent
Nakashima et al.

(10) Patent No.: US 8,567,566 B2
(45) Date of Patent: Oct. 29, 2013

(54) OIL PAN STRUCTURE

(75) Inventors: Jun Nakashima, Hiroshima (JP); Kenya Ishii, Hiroshima (JP); Toshihiro Yamane, Higashihiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 235 days.

(21) Appl. No.: 12/862,106

(22) Filed: Aug. 24, 2010

(65) Prior Publication Data

US 2011/0073062 A1 Mar. 31, 2011

(30) Foreign Application Priority Data

Sep. 30, 2009 (JP) ..... 2009-226709

(51) Int. Cl.
*F16N 31/00* (2006.01)
*F02F 7/00* (2006.01)

(52) U.S. Cl.
USPC ..... 184/106; 123/195 C; 123/195 R; 123/196 R

(58) Field of Classification Search
USPC ..... 123/195 C, 196 R, 195 R, 192.2; 184/106
See application file for complete search history.

(56) References Cited

U.S. PATENT DOCUMENTS

| | | | | |
|---|---|---|---|---|
| 4,395,982 | A * | 8/1983 | Moller | 123/195 C |
| 5,653,205 | A * | 8/1997 | Ozeki | 123/195 C |
| 5,852,991 | A * | 12/1998 | Yamamura et al. | 123/195 C |
| 6,183,632 | B1 * | 2/2001 | Covington | 210/167.02 |
| 6,588,489 | B1 * | 7/2003 | Vert et al. | 164/340 |
| 6,640,767 | B2 * | 11/2003 | Kato et al. | 123/195 C |
| 6,796,283 | B1 * | 9/2004 | Fleury et al. | 123/196 R |
| 7,188,708 | B2 * | 3/2007 | Osman | 184/106 |
| 8,011,340 | B2 * | 9/2011 | Bicker et al. | 123/195 C |
| 2009/0145395 | A1 * | 6/2009 | Ishii et al. | 123/195 C |
| 2009/0151690 | A1 * | 6/2009 | Sugiyama | 123/195 C |

FOREIGN PATENT DOCUMENTS

| | | | |
|---|---|---|---|
| EP | 1482134 | A2 * | 12/2004 |
| JP | 63078147 | U | 5/1988 |
| JP | 08074547 | A * | 3/1996 |
| JP | 2002276324 | A * | 9/2002 |

OTHER PUBLICATIONS

Notice of Reasons for Rejection of Japanese Patent Application No. 2009-226709 which cites JP Utility Model Application Publication No. S63-078147; Sep. 8, 2011, 12 pages, Japanese Patent Office.

* cited by examiner

*Primary Examiner* — Lindsay Low
*Assistant Examiner* — Kevin Lathers
(74) *Attorney, Agent, or Firm* — Alleman Hall McCoy Russell & Tuttle LLP

(57) ABSTRACT

There is provided, in one aspect of the present description, an oil pan structure attached to a lower portion of an engine for a vehicle. In one example, the oil pan structure comprises has an approximately rectangular bottom wall which accumulates oil continually, a long side wall, and a short side wall, the approximately rectangular bottom wall being surrounded by the long side wall and the short side wall. Further, the bottom wall has a deep bottom section provided approximately in a center of the bottom wall and in a portion where the oil is pumped up, a shallow bottom section which has a depth that is shallower than that of the deep bottom section, and a connecting wall section extending vertically and connecting the deep bottom section with the shallow bottom section, the shallow bottom section being provided on both sides of the deep bottom section.

10 Claims, 9 Drawing Sheets

OIL PAN STRUCTURE

FIELD OF THE INVENTION

The present invention relates to an oil pan structure, and more specifically to an oil pan structure provided in a lower portion of an engine for a vehicle.

BACKGROUND OF THE INVENTION

An oil pan provided in a lower portion of an engine for a vehicle has an approximately rectangular bottom wall extending in a direction of each cylinder line as viewed from the upper side, as disclosed in, for example, U.S. Patent Publication No. 2009/0151690. The oil pan has a deep bottom section provided on one side of the bottom wall and a shallow bottom section provided on the other side of the bottom wall. Plural reinforcing ribs are formed on an inside of both the deep bottom section and the shallow bottom section, and plural reinforcing ribs are formed also on an outside of the shallow bottom section. In this way, the conventional oil pan structure has plural reinforcing ribs provided on the bottom wall, which can not only increase rigidity of the bottom wall, but also reduce vibration of the bottom wall.

However, the above oil pan structure may result in an increased weight of the oil pan, due to the reinforcing ribs.

The present invention is made so as to address such a problem. Therefore, a purpose of the invention is to provide an oil pan structure, wherein the rigidity of the bottom wall could be increased while reducing the weight of the oil pan.

SUMMARY

To achieve the above purpose, in accordance with an aspect of the invention, an oil pan structure of an engine for a vehicle comprises an oil pan attached to a lower portion of the engine having plural cylinders, wherein the oil pan has an approximately rectangular bottom wall which accumulates oil continually and extends in a direction of each cylinder line as viewed from an upper side, a long side wall extending parallel to the cylinder line, and a short side wall extending perpendicular to the cylinder line, the approximately rectangular bottom wall is surrounded by the long side wall and the short side wall, the bottom wall has a deep bottom section provided approximately in a center of the bottom wall and in a portion where the oil is pumped up, a shallow bottom section which has a depth that is shallower than that of the deep bottom section, and connecting wall section extending vertically and connecting the deep bottom section with the shallow bottom section, and the shallow bottom section is provided on both sides of the deep bottom section.

According to above configuration, the bottom wall is divided into the deep bottom section and the shallow bottom section which can be formed respectively in a flat shape. And the deep bottom section is connected with the shallow bottom section via the connecting wall section which extends vertically and functions as a reinforcing rib. This could advantageously result in increasing the rigidity of the bottom wall and reducing vibration of the bottom wall without increasing thickness of the bottom wall or providing excessive reinforcing ribs on the inside of the bottom wall. Additionally, by providing the shallow bottom sections on both sides of the deep bottom section, it might restrain the oil from moving to one side during accelerating, decelerating or curve traveling of the vehicle. This can advantageously result in keeping the oil level high in the deep bottom section.

Preferably, the bottom wall might have first deep bottom extending sections extending respectively from the deep bottom section in both directions parallel to the cylinder line as viewed from the upper side, and second deep bottom extending sections extending respectively from the first deep bottom extending sections in at least one of both directions perpendicular to the cylinder line as viewed from the upper side. According to above configuration, a length of the connecting wall section might be increased as the second deep bottom extending sections are provided so as to extend further from the first deep bottom extending sections.

Preferably, the second deep bottom extending sections might extend respectively from the first deep bottom extending sections so as to be positioned diagonally across the deep bottom section. And the connecting wall section might connect the deep bottom section, the first deep bottom extending section and the second deep bottom extending section with the shallow bottom section, and might extend in an approximately L shape as viewed from the upper side. According to above configuration, the rigidity of the bottom wall could be further increased as the connecting wall section might extend in an approximately L shape in the bottom wall.

Preferably, the bottom wall might have deep bottom extending sections extending respectively from the deep bottom section in four directions parallel to or perpendicular to the cylinder line as viewed from the upper side, and the shallow bottom section might be positioned outside of each deep bottom extending section. According to above configuration, the rigidity of the bottom wall could be further increased as the connecting wall section in an approximately L shape might be positioned around the deep bottom section.

Preferably, the short side wall and the bottom wall might be connected to each other via a step wall section protruding inward of the oil pan. According to above configuration, the oil level can be kept high without reducing much space in the oil pan.

Preferably, the bottom wall, the long side wall and the short side wall might be formed by casting light alloy. According to above configuration, a weight of the whole oil pan structure could be reduced, and manufacturing cost could also be reduced.

According to above oil pan structure, the rigidity of the bottom wall could be increased while reducing the weight of the oil pan.

DESCRIPTION OF EMBODIMENT

Figure 1:
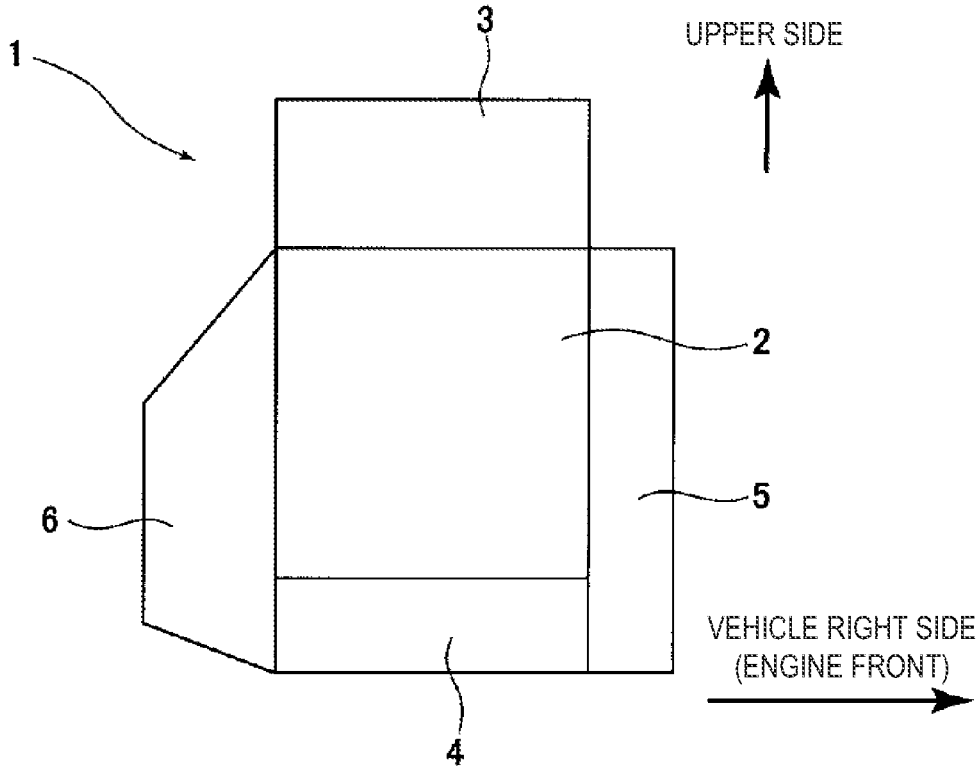
FIG. 1 is a side view of an engine for a vehicle according to an embodiment of the invention.

Next, an embodiment of the invention is described with reference to the appended drawings. First, with reference to FIGS. 1 to 5, 6A to 6C, and 7A and 7B, a configuration of an oil pan structure according to this embodiment is described. FIG. 1 is a schematic diagram of a multi-cylinder engine 1 for a vehicle carried in an engine room of the vehicle, as viewed from the rear side of the vehicle. In this embodiment, the engine 1 is arranged in the transverse direction in the engine room (i.e., a transverse engine or east-west engine) where the engine is oriented such that the engine front faces to a side of the vehicle (in this embodiment, to the right).

As shown in FIG. 1, the transverse engine 1 oriented so that two or more cylinders are arranged in the engine front-and-rear direction, includes a cylinder block 2, a cylinder head 3 attached to an upper part of the cylinder block 2, and an oil pan 4 attached to a lower part of the cylinder block 2. Each of the cylinders reciprocates along a respective cylinder line within the cylinder block, driven by connecting rods connected to a crankshaft of the engine. A front cover 5 and a transmission case 6 are attached to the engine front (right side of the vehicle) and the engine rear (left side of the vehicle), respectively.

As shown in FIGS. 2 to 5, the oil pan 4 has a dimension in the engine front-and-rear direction (longitudinal direction) greater than its width direction dimension, and has a substantially rectangular shape in the top view. The oil pan 4 of this embodiment is integrally formed by casting light alloy (for example, aluminum alloy). Thereby, the oil pan 4 of this embodiment can suppress noise radiation, as well as reduce weight and cost.

The oil pan 4 includes a bottom wall 10 of a substantially rectangular shape in the top view, which continually reserves engine oil, and a side wall section 20 extending upwardly so as to surround the bottom wall 10. Thus, it will be appreciated that the bottom wall 10 of the oil pan extends in a direction of the cylinder lines of the engine, which are parallel to the engine front-and-rear direction, such that a long axis of the rectangular shape of the bottom wall 10 is oriented in the engine front rear direction, and a short axis of the rectangle is oriented in the width direction.

Figure 2:
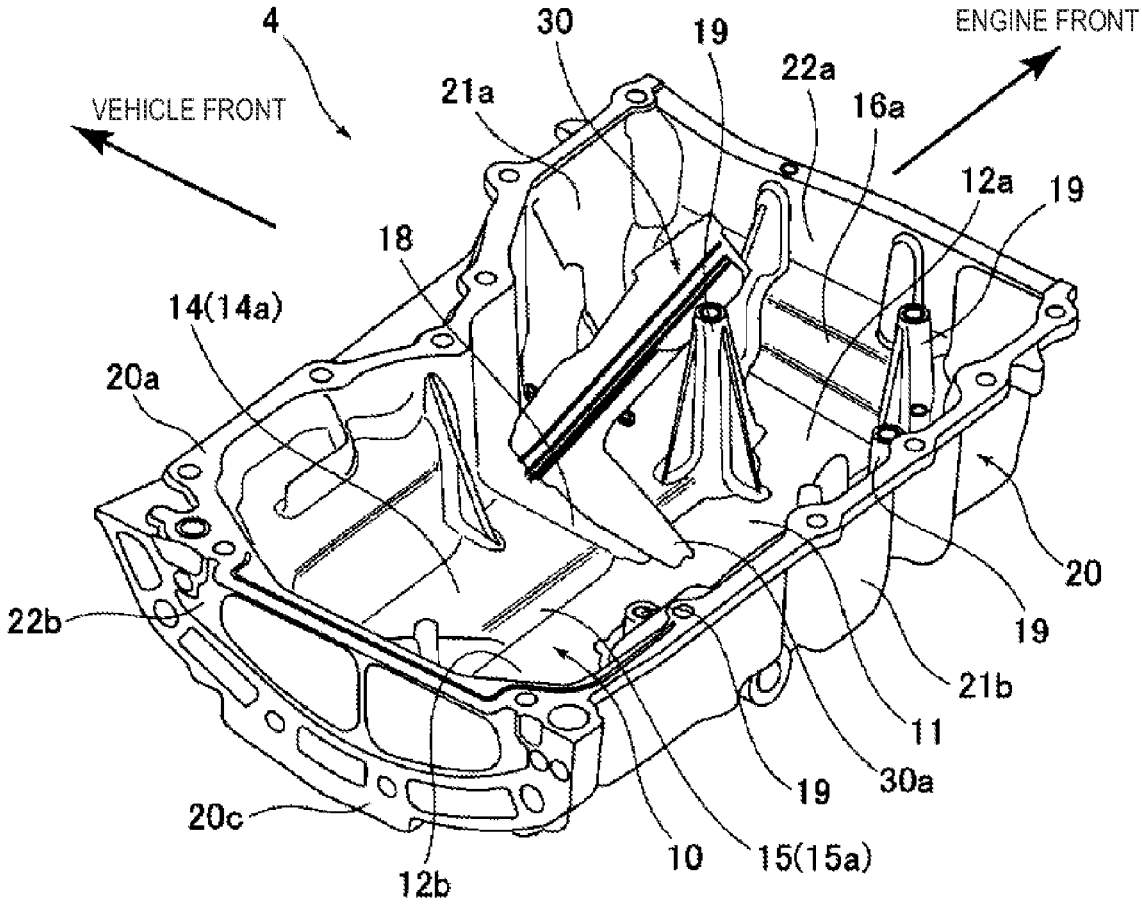
FIG. 2 is a perspective view of an oil pan of this embodiment.
Figure 5:
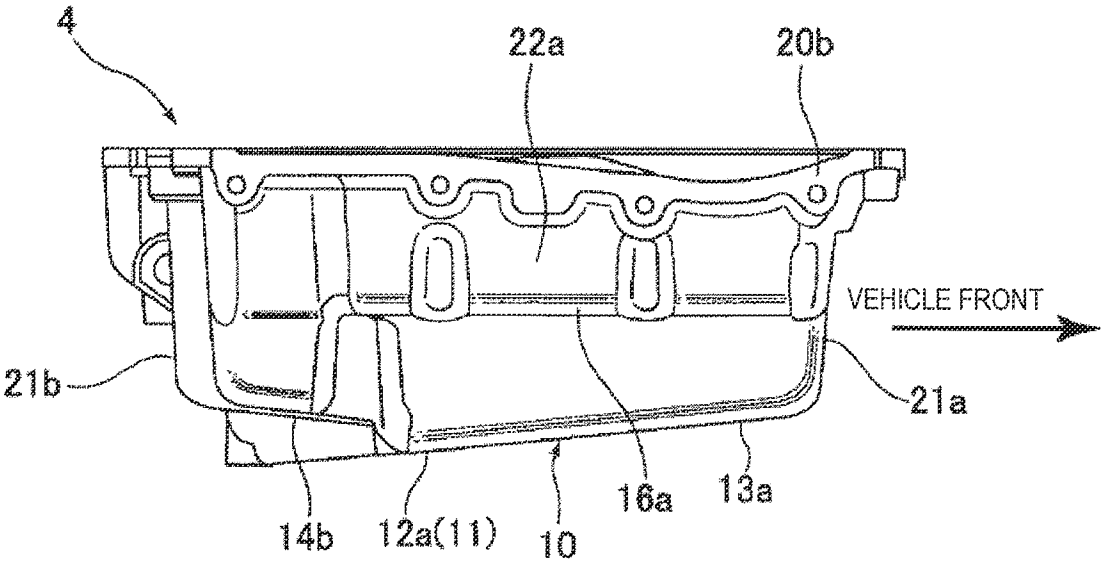
FIG. 5 is a right side view of the oil pan shown in FIG. 2.

The side wall section 20 includes a pair of long side wall sections 21*a* and 21*b* extending in the long-side direction (the longitudinal direction or the engine front-and-rear direction), and a pair of short side wall sections 22*a* and 22*b* extending in the short-side direction (the transverse direction or the engine width direction). A cylinder-block-attachment flange part 20*a* is formed in an upper end part of the side wall section 20 so as to join to the cylinder block 2. As shown in FIG. 5, a front-cover-attachment flange part 20*b* is formed in the short side wall section 22*a* of the side wall section 22 on the engine front side. In addition, as shown in FIG. 2, a transmission-case-attachment flange part 20*c* is formed in the short side wall section 22*b* of the side wall section 22 on the engine rear side.

The bottom wall 10 includes a deep bottom section 11 that is located substantially at the center of the rectangular-shaped bottom wall 10 in the top view and used as an oil pumping part, and a shallow bottom section 14 that is shallower than the deep bottom section 11. Further, the bottom wall 10 includes deep bottom extending sections 12*a* and 12*b* extending from the deep bottom section 11 to both directions of the engine front direction and the engine rear direction, which are the longitudinal direction in the top view, and deep bottom re-extending sections 13*a* and 13*b* extending from both the deep bottom extending sections 12*a* and 12*b* to the vehicle front direction and the vehicle rear direction, respectively, which are the short-side direction in the top view.

The deep bottom section 11, the deep bottom extending sections 12*a* and 12*b*, and the deep bottom re-extending sections 13*a* and 13*b* are connected with the shallow bottom sections 14*a* and 14*b* so that they continue via a connecting wall section 15 extending in the up-and-down direction. In this embodiment, the deep bottom section 11, the deep bottom extending sections 12*a* and 12*b*, and the deep bottom re-extending sections 13*a* and 13*b* are continuously formed without a level difference. Preferably, these sections are configured to form the same plane, and this resulted plane may be a horizontal surface or may be a sloped surface.

In this embodiment, because the deep bottom section 11, the deep bottom extending sections 12*a* and 12*b*, and the deep bottom re-extending sections 13*a* and 13*b* are arranged as described above, the shallow bottom sections 14*a* and 14*b* are located at two diagonal places in the bottom wall 10 across the deep bottom section 11.

For this reason, the connecting wall section 15 extends in a substantially L shape in the top view at two places in the bottom wall 10. In detail, the connecting wall section 15*a* located in the vehicle front side and the connecting wall section 15*b* located in the vehicle rear side are formed, and each has a configuration such that a part extending in the engine longitudinal direction and a part extending in the engine transverse direction (engine width direction) are coupled substantially at an angle of 90°.

Figure 3:
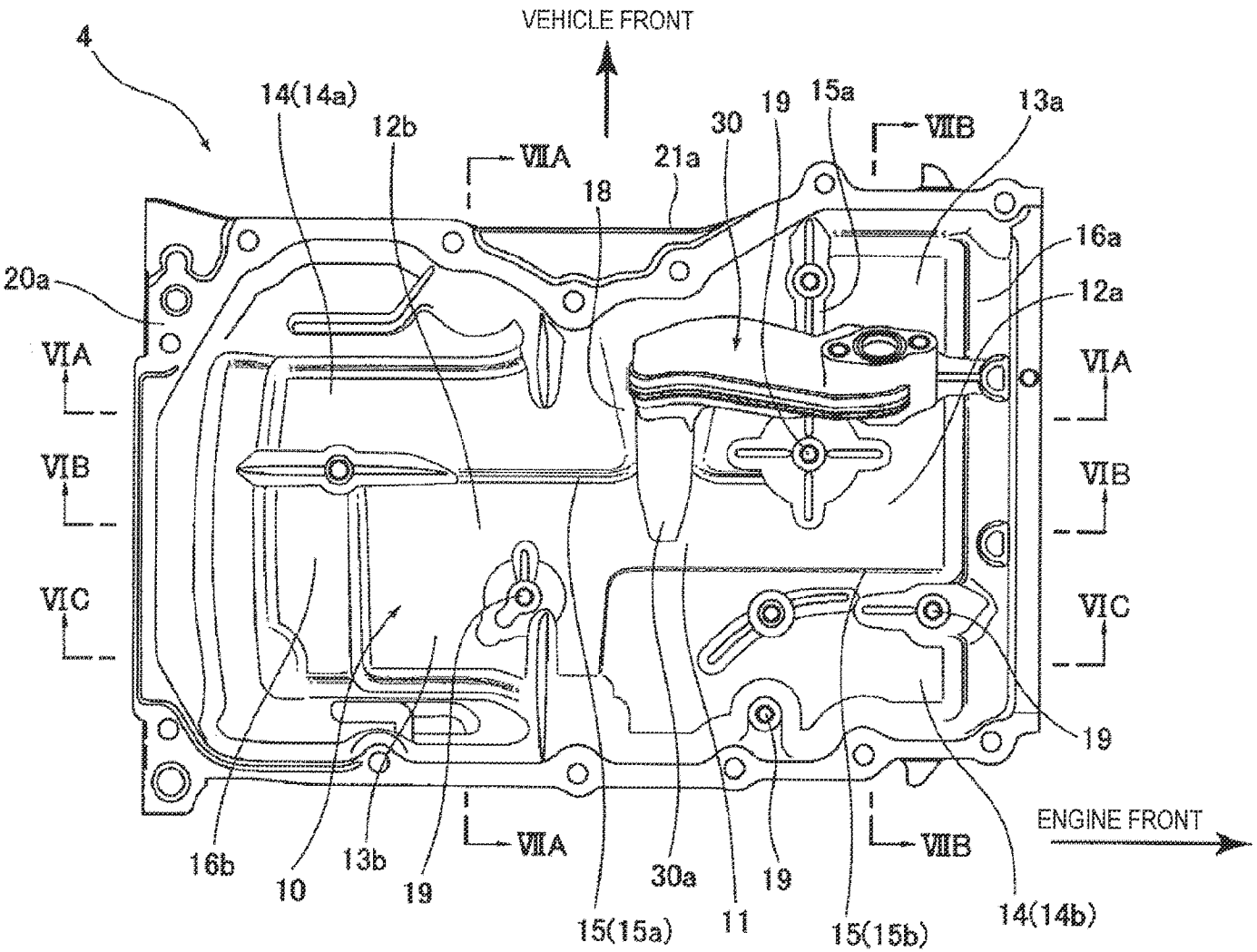
FIG. 3 is a top view of the oil pan shown in FIG. 2.
Figure 4:
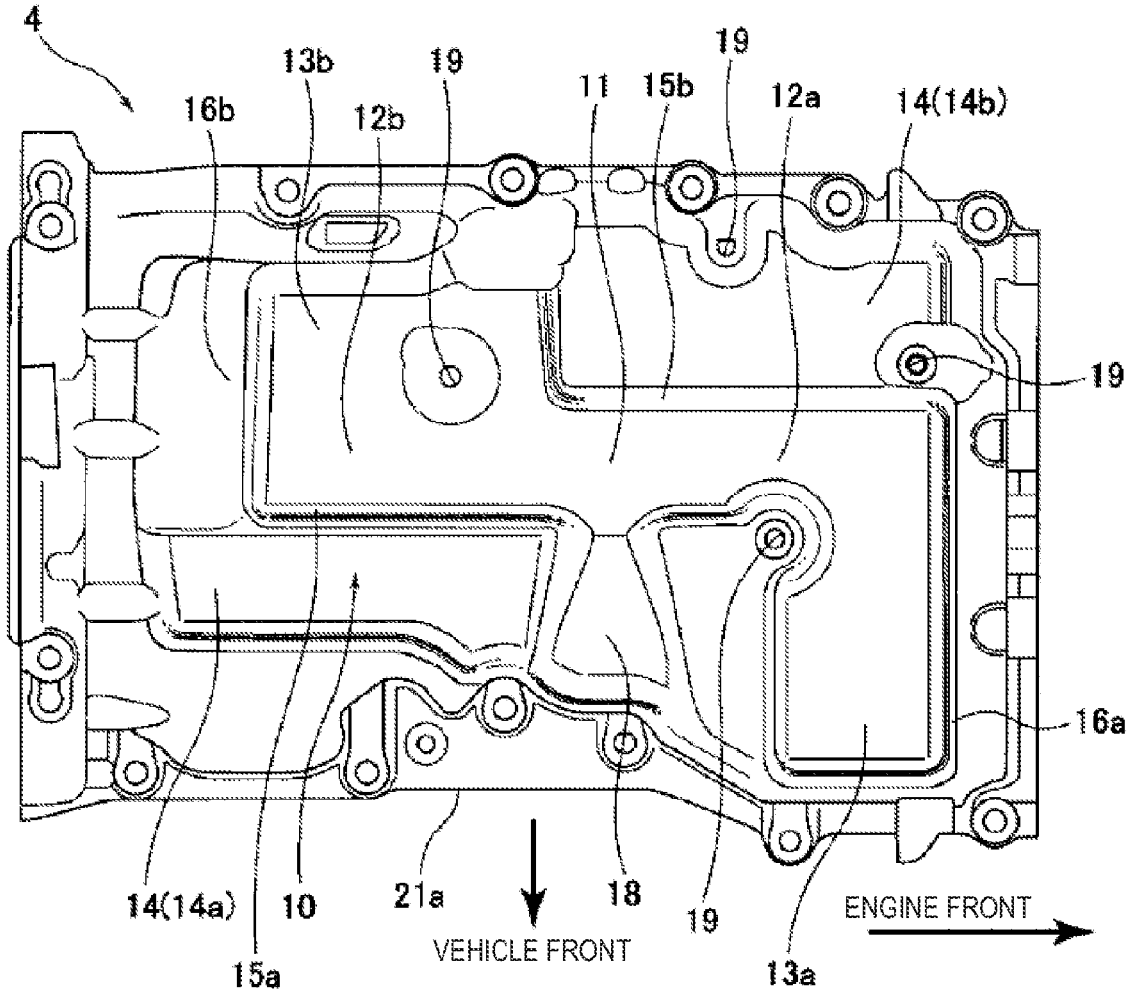
FIG. 4 is a bottom view of the oil pan shown in FIG. 2.

As shown in FIGS. 1 and 3, in the oil pan 4, an oil strainer 30 with a built-in filter is arranged. A tip part of a suction side end part 30*a* of the oil strainer 30 is located in the deep bottom section 11, and the suction side end part 30*a* is arranged so as to stand diagonally from the deep bottom section 11.

In order to avoid interference with the suction side end part 30*a*, a concave portion 18 is formed in a part of the shallow bottom section 14*a*. The suction side end part 30*a* is arranged so as to fit in the concave portion 18. Note that, in this embodiment, a part of the connecting wall section 15*a* is cut so as to form the concave portion 18, but, without limiting to this configuration, the oil strainer 30 may be arranged without the concave portion 18 being formed to not cut the part of the connecting wall section 15*a*, for example.

Level difference wall sections 16*a* and 16*b* are formed in the connecting part between the short side wall sections 22*a* and 22*b* and the bottom wall 10 so that each is depressed inwardly of the oil pan 4. Attachment boss parts 19 for attaching a baffle plate (not shown) upwardly from the bottom wall 10 are formed at four places. These are formed so as to avoid interference with the oil strainer 30.

Figure 6A:
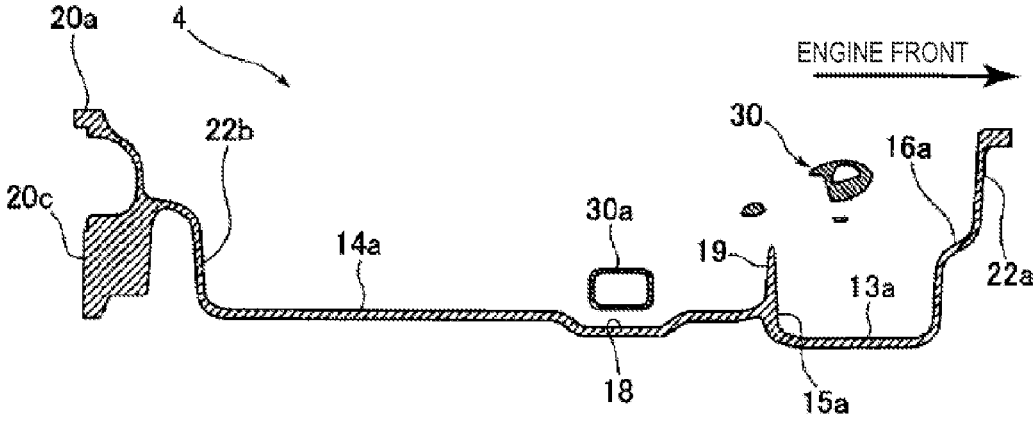
FIGS. 6A to 6C are end elevational views of the oil pan shown in FIG. 2.
Figure 6B:
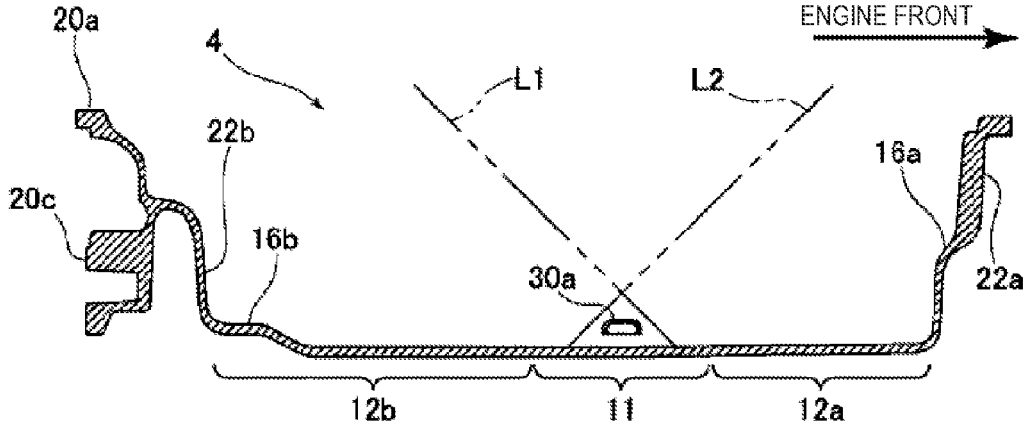
Figure 6C:
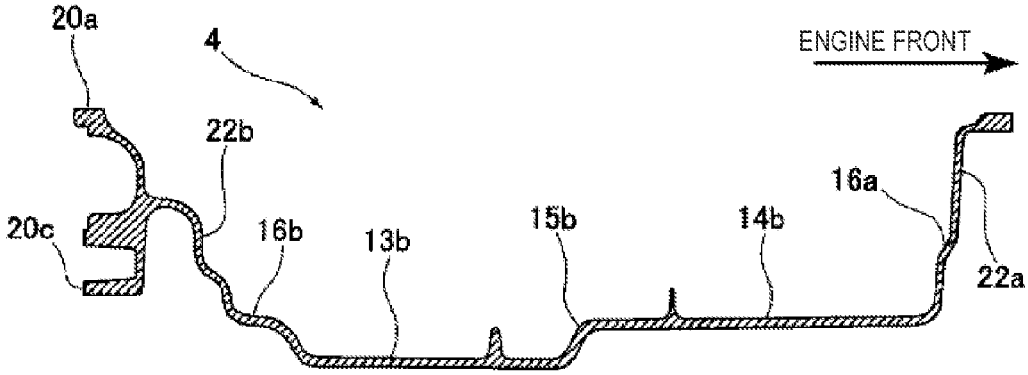
Figure 7A:
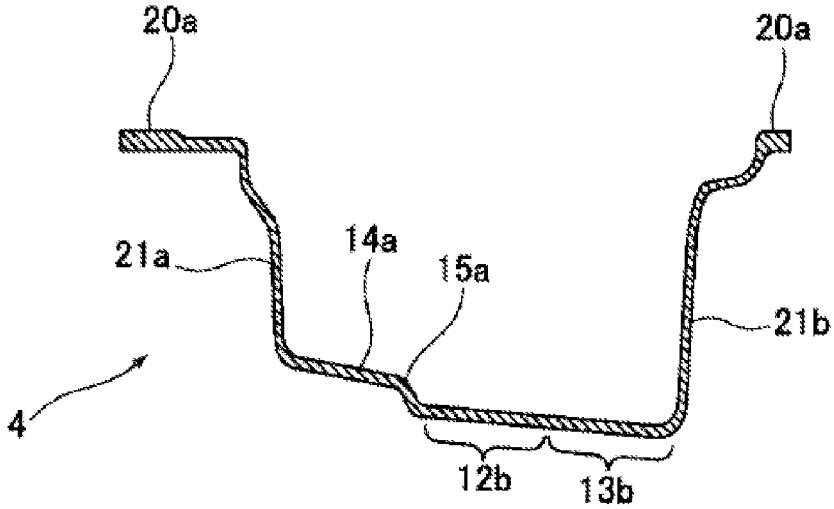
FIGS. 7A and 7B are end elevational views of the oil pan shown in FIG. 2.
Figure 7B:
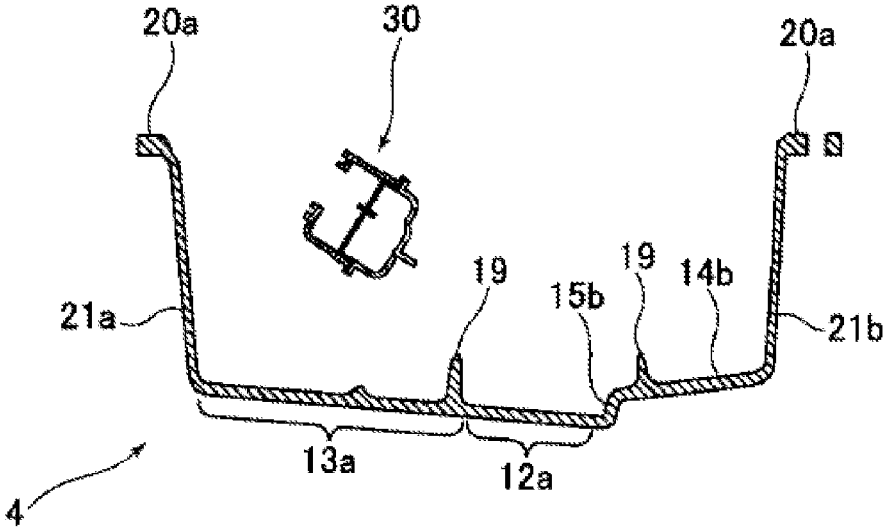

Next, referring to FIGS. 6A to 6C, and 7A and 7B, cross-sectional shapes of the bottom wall 10 of this embodiment are described. FIGS. 6A to 6C show end elevational views of the oil pan 4 in the engine longitudinal direction. FIGS. 7A and 7B show end elevational views of the oil pan 4 in the engine width direction.

FIG. 6A is an end elevational view in the longitudinal direction at a position including the shallow bottom section 14*a* and the concave portion 18. In this figure, the shallow bottom section 14*a* is located on the left side, and the deep bottom re-extending section 13*a* is located on the right side of the shallow bottom section 14. The shallow bottom section 14*a* and the deep bottom re-extending section 13*a* are connected with each other by the connecting wall section 15*a* extending in the up-and-down direction. Note that, at the position shown in FIG. 6A, a part of the attachment boss part 19 continues from the connecting wall section 15*a*. In addition, the deep bottom re-extending section 13*a* is connected with the short side wall section 22*a* via the level difference wall section 16*a*.

FIG. 6B is an end elevational view in the longitudinal direction in a substantially center part of the oil pan 4 in the width direction, and it does not include the shallow bottom section 14. As shown in FIG. 6B, a tip part of the suction side end part 30*a* of the oil strainer 30 is located near the bottom of the deep bottom section 11, and the deep bottom section 11 serves as an oil pumping part. The deep bottom extending sections 12*a* and 12*b* are connected with the short side wall sections 22*a* and 22*b* via the level difference wall sections 16*a* and 16*b*, respectively.

FIG. 6C is an end elevational view in the longitudinal direction at a position including the shallow bottom section 14*b*. In this figure, the deep bottom re-extending section 13*b* is located on the left side, and the shallow bottom section 14*b* is located on the right side of the deep bottom re-extending section 13*b*. The deep bottom re-extending section 13*b* and the shallow bottom section 14*b* are connected by the connecting wall section 15*b* extending substantially in the up-and-down direction. The deep bottom re-extending section 13*b* is connected with the short side wall section 22*b* via the level difference wall section 16*b*, and the shallow bottom section 14*b* is connected with the short side wall section 22*a* via the level difference wall section 16*a*.

FIG. 7A is an end elevational view in the short-side direction (width direction) at a position including the shallow bottom section 14*a*. In this figure, the shallow bottom section 14*a* is located in an upper part, the deep bottom extending section 12*b* is located in a center part, and the deep bottom re-extending section 13*b* is located in a lower part. The shallow bottom section 14*a* and the deep bottom extending section 12*b* are connected by the connecting wall section 15*a* extending substantially in the up-and-down direction.

FIG. 7B is an end elevational view in the short-side direction (width direction) at a position including the shallow bottom section 14*b*. In this figure, the deep bottom re-extending section 13*a* is located in an upper part, the deep bottom extending section 12*a* is located in a center part, and the shallow bottom section 14*b* is located in a lower part. The deep bottom extending section 12*a* and the shallow bottom section 14*b* are connected by the connecting wall section 15*b* extending substantially in the up-and-down direction.

Next, an operation of the oil pan structure of this embodiment is described. As described above, the oil pan 4 of this embodiment has the bottom wall 10 of the substantially rectangular shape in the top view. The deep bottom section 11 used as the oil pumping part is provided to a substantially center part of the bottom wall 10 in the longitudinal direction and the short-side direction (the width direction or the transverse direction). The deep bottom extending sections 12*a* and 12*b* extend in the longitudinal direction from the deep bottom section 11 to both sides, respectively.

The deep bottom re-extending sections 13*a* and 13*b* are formed so as to extend from the deep bottom extending sections 12*a* and 12*b* to the vehicle front (engine left) and to the vehicle rear (engine right), respectively. The deep bottom section 11, the deep bottom extending sections 12*a* and 12*b*, and the deep bottom re-extending sections 13*a* and 13*b* are formed so that their bottom surfaces continue without a level difference mutually.

Among the bottom wall 10, parts other than the deep sections (i.e., the deep bottom section 11, the deep bottom extending sections 12*a* and 12*b*, the deep bottom re-extending sections 13*a* and 13*b*), the shallow bottom sections 14*a* and 14*b* shallower than the deep sections are formed at least on both sides of the deep bottom section 11 in the longitudinal direction or in the short-side direction (the width direction or the transverse direction). The deep sections and the shallow sections (the shallow bottom sections 14*a* and 14*b*) are connected with each other so that they continue by the connecting wall sections 15*a* and 15*b* extending in the up-and-down direction, respectively.

As described above, because the rectangular section of the bottom wall 10 in the plan view is sectioned into the deep sections and the shallow sections, film vibration (vibration of the bottom wall) can be reduced, and the bottom surface can be configured in the planar shape without providing inner rib(s) in each section. In this embodiment, because the connecting wall section 15 that connects both the sections functions as reinforcing rib(s), thereby, a surface rigidity of the bottom wall 10 can be improved. Further, because the connecting wall sections 15*a* and 15*b* do not have a configuration which partially projects inside unlike the conventional inner rib(s), they do not increase in weight, are simple in structure, and can reduce a manufacture cost.

In this embodiment, because the shallow bottom section 14 is provided, an oil level in the deep bottom section 11 can be maintained high. Further, in this embodiment, the shallow bottom sections 14*a* and 14*b* are located on both sides of the deep bottom section 11, which is the oil pumping part, at least in the longitudinal direction or the short-side direction (the width direction or the transverse direction), as described above. Alternatively, the shallow bottom sections 14*a* and 14*b* are specifically located diagonally to the deep bottom section 11. Thus, because the shallow bottom sections 14*a* and 14*b* are located on both sides of the deep bottom section 11 in the engine front-and-rear direction and the engine left-and-right direction, even if the engine oil slants toward either direction inside the oil pan 4 at the time of turning, accelerating, braking and the like, the suction side end part 30*a* of the oil strainer 30 can be held below the oil surface. FIG. 6B shows an example oil surface L1 when the vehicle turns right, and an oil surface L2 when the vehicle turns left.

Further, in this embodiment, because the level difference wall sections 16*a* and 16*b* are formed in the connecting part of the short side wall sections 22*a* and 22*b* and the bottom wall 10 so that they are depressed inwardly of the oil pan 4, the oil level can be maintained high, sacrificing less inner space. Further, by forming the level difference wall sections 16*a* and 16*b* as described above, the surface rigidity of the bottom wall 10 can be further increased. In this embodiment, although the level difference wall section is formed along with the short side wall sections 22*a* and 22*b*, the level difference wall section may be formed along the long side wall sections 21*a* and 21*b*, without limitation.

In this embodiment, because the connecting wall sections 15*a* and 15*b* are formed in a substantially L shape and an inverted L shape in the top view, respectively, the surface rigidity of the bottom wall 10 can be further increased. In this embodiment, because the shallow bottom sections 14*a* and 14*b* are arranged diagonally, and thereby, the substantially L shaped connecting wall sections 15*a* and 15*b* are also located diagonally, the surface rigidity in the engine front-and-rear direction can be increased with a sufficient balance, and the film vibration can be suppressed.

Figure 8A:
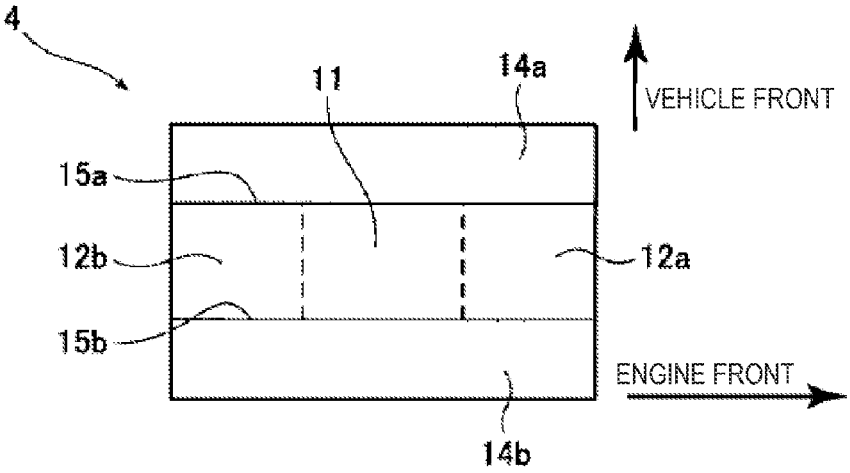
FIGS. 8A to 8C are views showing modified examples of the oil pan shown in FIG. 2.
Figure 8B:
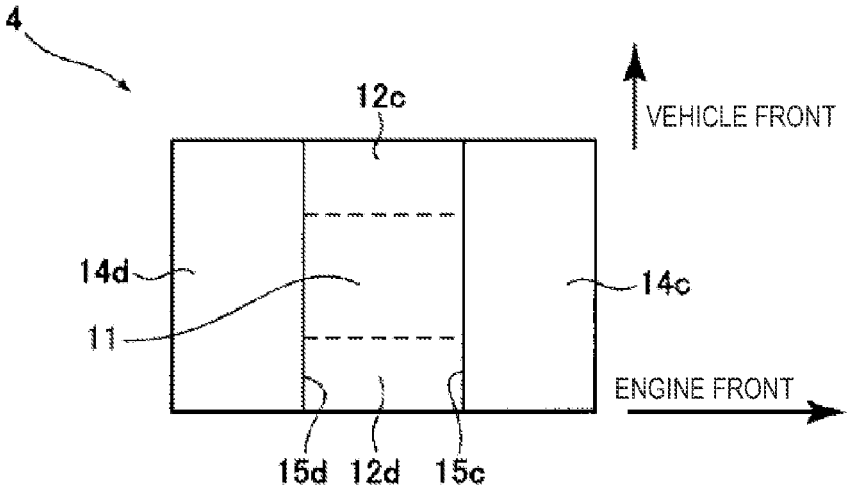
Figure 8C:
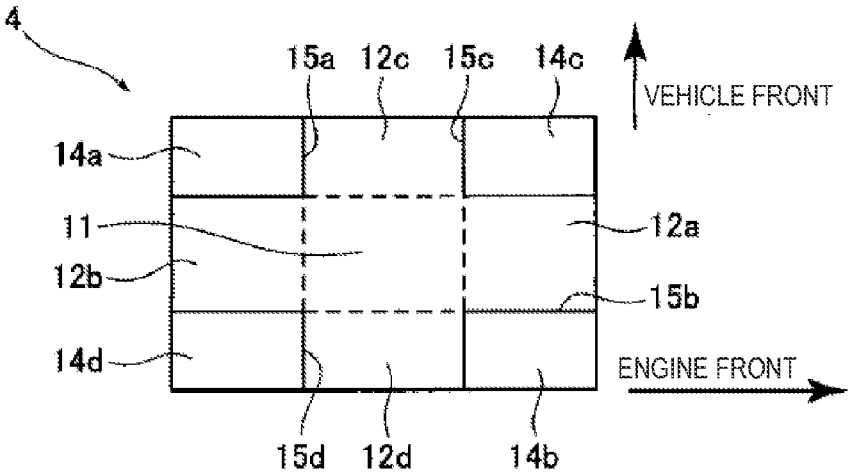

Next, modified embodiments of the invention are described with reference to FIGS. 8A to 8C, and 9A and 9B. FIGS. 8A to 8C are schematic top views of the oil pan 4, and show various division forms of the bottom wall 10. Also in the examples of FIGS. 8A to 8C, the engine 1 is arranged as the transverse engine. Also in the examples of FIGS. 8A to 8C, and FIGS. 9A and 9B, the level difference wall section may be or may not be provided.

FIG. 8A shows a configuration in which the deep bottom extending sections 12*a* and 12*b* extend on both sides in the longitudinal direction from the deep bottom section 11, and the shallow bottom sections 14*a* and 14*b* are formed on both sides of the deep bottom section 11 in the short-side direction (the width direction or the transverse direction) so as to extend throughout the length of the oil pan 4. In FIG. 8A, each section is distinguished from the others by dashed lines in order to facilitate understanding thereof. The connecting wall sections 15*a* and 15*b* are formed along the longitudinal direction so that the deep bottom section 11, the deep bottom extending sections 12*a* and 12*b*, and the shallow bottom sections 14*a* and 14*b* are coupled.

In the example of FIG. 8A, although the deep bottom re-extending section is not formed, the deep bottom re-extending section may also be formed so as to extend from one or both of the deep bottom extending sections 12*a* and 12*b* toward one direction or both directions in the short-side direction (the width direction or the transverse direction).

FIG. 8B shows a configuration in which the deep bottom extending sections 12*c* and 12*d* extend on both sides in the short-side direction (the width direction or the transverse direction) from the deep bottom section 11, and the shallow bottom sections 14*c* and 14*d* are formed on both sides of the deep bottom section 11 in the longitudinal direction so as to extend throughout the width of the oil pan 4. In FIG. 8B, each section is distinguished from the others by dashed lines in order to facilitate understanding thereof. The connecting wall sections 15*c* and 15*d* are formed along the short-side direction (the width direction or the transverse direction) so that the deep bottom section 11, the deep bottom extending sections 12*c* and 12*d*, and the shallow bottom sections 14*c* and 14*d* are coupled.

In the example of FIG. 8B, although the deep bottom re-extending section is not formed, the deep bottom re-extending section may also be formed so as to extend from one or both of the deep bottom extending sections 12*c* and 12*d* toward one direction or both directions in the longitudinal direction.

FIG. 8C shows a configuration in which the deep bottom extending sections 12*a*, 12*b*, 12*c*, and 12*d* extend in a cross shape from the deep bottom section 11 to both sides in the longitudinal direction and to both sides in the short-side direction, and the shallow bottom sections 14*a*, 14*b*, 14*c*, and 14*d* are formed in four corners of the bottom wall 10. In FIG. 8C, each section is distinguished by dashed lines in order to facilitate understanding thereof. The connecting wall sections 15*a*, 15*b*, 15*c*, and 15*d* are formed in a substantially L shape, respectively, so that the deep bottom section 11, the deep bottom extending sections 12*a*, 12*b*, 12*c*, and 12*d*, and the shallow bottom sections 14*a*, 14*b*, 14*c*, and 14*d* are coupled.

In the example of FIG. 8C, although the deep bottom extending section extends from the deep bottom section 11 in four directions along the longitudinal direction and the short-side direction (the width direction or the transverse direction), the direction may include, but is not limited to, any one direction, any two directions, and any three directions.

As described above, even if the bottom wall 10 is divided into the deep sections and the shallow sections, because the connecting wall section 15, which couples these sections serves as the reinforcing rib, the surface rigidity of the bottom wall 10 can be increased as a whole, and the film vibration (vibration of the bottom wall) can be reduced.

Figure 9A:
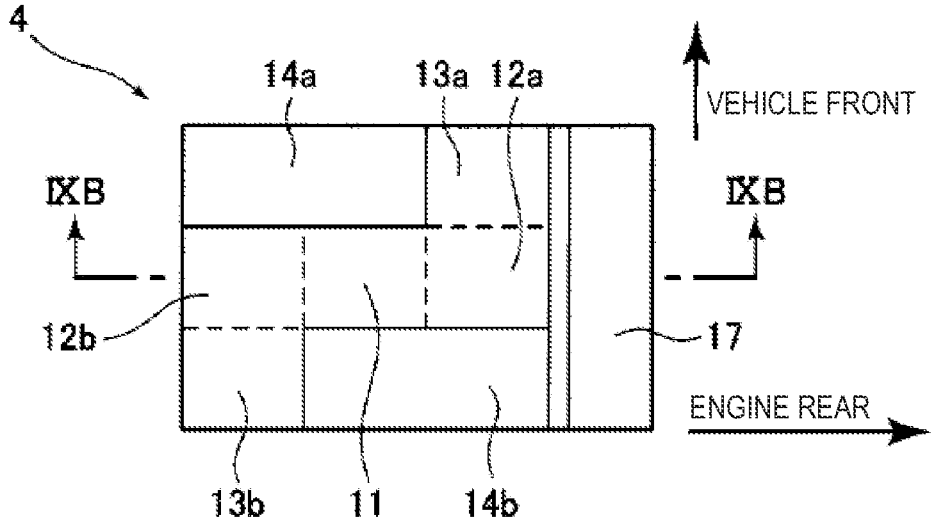
FIGS. 9A and 9B are views showing another modified example of the oil pan shown in FIG. 2.
Figure 9B:
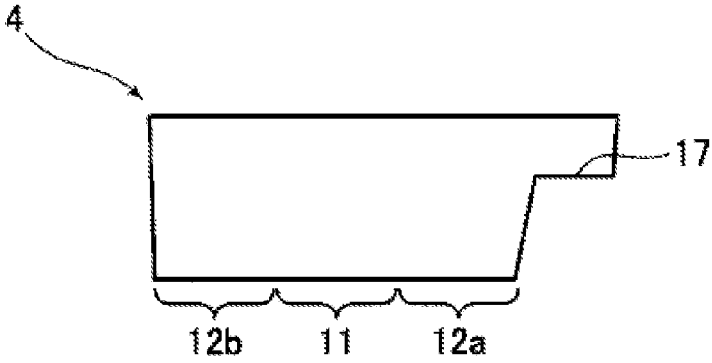

FIGS. 9A and 9B show an example in which a projected part 17 where one side in the longitudinal direction (in this example, the engine rear side) is formed shallower than the shallow bottom section is provided. In the form where such a projected part 17 is provided, the invention may be applied to other principal parts to form the deep bottom section 11, the shallow bottom section 14, and the like.

In the above embodiment, although the example in which the engine 1 is the transverse engine, the engine may alternatively be, but not limited to, a longitudinal engine or north-south engine where the engine is arranged so that its longitudinal direction is oriented in the vehicle front-and-rear direction. Also in the oil pan 4 arranged as described above, the slanting of the engine oil can be suppressed at the time of accelerating, braking, and turning, to maintain the deep bottom section 11 or the suction side end part 30*a* of the oil strainer 30 below the oil surface.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An oil pan structure of an engine for a vehicle, comprising an oil pan attached to a lower portion of the engine having plural cylinders, wherein the oil pan has an approximately rectangular bottom wall which accumulates oil continually and extends in a direction of each cylinder line as viewed from an upper side, a long side wall extending parallel to the cylinder line, and a short side wall extending perpendicular to the cylinder line, the approximately rectangular bottom wall being surrounded by the long side wall and the short side wall, the bottom wall has a flat deep bottom section provided approximately in a center of the bottom wall and in a portion where the oil is pumped up, a shallow bottom section which has a depth that is shallower than that of the deep bottom section, and a connecting wall section extending vertically and connecting the deep bottom section with the shallow bottom section, the shallow bottom section is provided on both sides of the deep bottom section, the bottom wall includes two flat L shaped regions which are located at respective diagonal positions across the deep bottom section, the L shaped regions each demarcated by the connecting wall section and respectively comprising first deep bottom extending sections extending in opposite directions away from the deep bottom section parallel to an engine longitudinal direction and respective second deep bottom extending sections extending from a distal end of the first deep bottom extending sections in opposite directions that are each perpendicular to the corresponding first deep bottom extending sections, and the connecting wall section connects the deep bottom section, the first deep bottom extending sections and the second deep bottom extending sections with the shallow bottom section, and extends in an approximately L shape as viewed from the upper side.

2. The oil pan structure according to claim 1 wherein the short side wall and the bottom wall are connected to each other via a step wall section protruding inward of the oil pan.

3. The oil pan structure according to claim 1 further comprising, a protrusion provided on one side in a direction parallel to the cylinder line as viewed from the upper side, a depth of the protrusion being shallower than that of the shallow bottom section.

4. The oil pan structure according to claim 1 wherein the bottom wall, the long side wall and the short side wall are formed by casting light alloy.

5. The oil pan structure according to claim 1 wherein the shallow bottom section includes regions that are provided on both sides of the deep bottom section in directions parallel to the cylinder line as viewed from the upper side.

6. The oil pan structure according to claim 5 wherein the short side wall and the bottom wall are connected to each other via a step wall section protruding inward of the oil pan.

7. The oil pan structure according to claim 5 wherein the bottom wall, the long side wall and the short side wall are formed by casting light alloy.

8. The oil pan structure according to claim 1 wherein the bottom wall has deep bottom extending sections, including the first and second deep bottom extending sections, which extend respectively from the deep bottom section in four directions parallel to or perpendicular to the cylinder line as viewed from the upper side, and the shallow bottom section is positioned outside of each deep bottom extending section.

9. The oil pan structure according to claim 8 wherein the short side wall and the bottom wall are connected to each other via a step wall section protruding inward of the oil pan.

10. The oil pan structure according to claim 8 wherein the bottom wall, the long side wall and the short side wall are formed by casting light alloy.

* * * * *